US006478195B2

(12) United States Patent
Duquet et al.

(10) Patent No.: US 6,478,195 B2
(45) Date of Patent: Nov. 12, 2002

(54) PACKAGING ASSEMBLY

(75) Inventors: Frédéric Duquet, Evreux (FR); Hervé Pennaneac'h, Verneuil sur Avre (FR)

(73) Assignee: Valois S.A., Neubourg (FR)

( * ) Notice: Subject to any disclaimer, the term of this patent is extended or adjusted under 35 U.S.C. 154(b) by 0 days.

(21) Appl. No.: 10/013,525

(22) Filed: Dec. 13, 2001

(65) Prior Publication Data

US 2002/0074346 A1 Jun. 20, 2002

(30) Foreign Application Priority Data

Dec. 20, 2000 (FR) ..... 00 16699

(51) Int. Cl.[7] ..... B67D 5/06
(52) U.S. Cl. ..... 222/183; 222/209; 222/214
(58) Field of Search ..... 222/105, 107, 222/212, 215, 541.6, 131, 183, 325, 209, 214; 220/266, 345.1

(56) References Cited

U.S. PATENT DOCUMENTS 4,987,999 A * 1/1991 Hehn ..... 220/345.1
5,080,222 A * 1/1992 McNary ..... 220/345.1
5,839,609 A * 11/1998 Zakensburg ..... 222/107

FOREIGN PATENT DOCUMENTS

GB 1279941 A 6/1972
WO WO 94/18931 A 9/1994

* cited by examiner

*Primary Examiner*—Philippe Derakshani
*Assistant Examiner*—Melvin A Cartagena
(74) *Attorney, Agent, or Firm*—Sughrue Mion, PLLC

(57) ABSTRACT

A packaging assembly, including a fluid dispenser defining substantially parallel opposite side edges, and a housing having two substantially parallel opposite sides. Each side defines an inside wall, with the two inside walls facing each other, and each inside wall is provided with a respective longitudinal groove which extends over at least a portion of the length of the side. The two resulting grooves are parallel, and at least a portion of each of the opposite side edges of the dispenser are slidably engaged in the corresponding one of the grooves in the housing, so as to enable the dispenser to be slidably extracted from the housing.

13 Claims, 3 Drawing Sheets

PACKAGING ASSEMBLY

The present invention relates to a packaging assembly comprising a fluid dispenser and a housing in which the fluid dispenser is inserted.

BACKGROUND OF THE INVENTION

Such a housing or box can be used in the fields of cosmetics or of perfumes to contain a dispenser so as to protect it and also so as to facilitate storing it in a stack. Such boxes or housings are generally rectangular block shaped with one side of the rectangular block forming a hinged opening. Such a housing conventionally has a top, a bottom, two sides, a back wall, and an opening front. The dispenser is, in general, received inside the housing in totally free manner, i.e. it can move to a very limited extent inside the housing. When the user wishes to take hold of the fluid dispenser, the user opens the opening front of the housing, and takes hold of the dispenser for the purpose of pulling it out of the housing.

Since the fluid dispenser is merely disposed inside the housing, it can move inside said housing and knock against its inside walls. Such impacts can not only damage the dispenser, they can also generate noise which may be undesirable under certain circumstances.

OBJECTS AND SUMMARY OF THE INVENTION

An object of the present invention is to remedy those drawbacks of the prior art by defining a packaging assembly in which the fluid dispenser is held stationary inside the housing, without complicating extracting the dispenser from the housing.

To solve this problem, the present invention provides a packaging assembly comprising: a fluid dispenser defining substantially parallel and preferably relatively thin opposite side edges; and a housing having two substantially parallel opposite sides; each side defining an inside wall, with the two inside walls facing each other, and each inside wall being provided with a respective longitudinal groove which extends over at least a portion of the length of the side, the two resulting grooves being parallel, at least a portion of each of the opposite side edges of the dispenser being slidably engaged in the corresponding one of said grooves in the housing, so as to enable the dispenser to be slidably extracted from the housing. Firstly it should be specified that the term "housing" should not be understood to be limiting. On the contrary, this term is used to designate any closed or open packaging in which the fluid dispenser is inserted in grooves formed by the two opposite sides. For example, the opposite sides may be interconnected merely by spacers, so that the fluid dispenser is visible from almost any angle. It is also possible to imagine other forms of housing with or without a top, with or without a back wall, and with or without an opening front wall. The essential condition for the housing lies in the fact that it has two opposite sides forming longitudinal grooves for slidably receiving the opposite edges of the fluid dispenser.

It should also be noted that extracting the dispenser from the housing is not made any more complicated by the fact that the edges of the dispenser slide in the grooves in the housing. On the contrary, the dispenser is guided accurately by the grooves so that it is extracted more linearly.

In one embodiment, the housing includes a back wall interconnecting the two sides at one end of each them, and an opening front at their other ends, and a top interconnecting the sides and the back wall. In which case, the housing does not have a bottom, but a bottom is however formed for it by a bottom of the dispenser, so that the bottom of the dispenser is visible when the dispenser is in its housing.

In addition, the dispenser may include a removable closure element closing off a fluid dispensing orifice, said closure element being defined by a line of least resistance. Advantageously, the closure element defines a portion of each of the opposite side edges of the dispenser, which portion is engaged in the grooves in the housing.

In a first practical embodiment, the housing includes a bottom which is parallel to said top and which interconnects the sides and the back wall.

In an alternative embodiment, only the opposite side edges of the closure element are engaged in the grooves of the housing. Advantageously, the grooves define respective abutment ends in the vicinity of the opening front so that the dispenser can be partially extracted from the housing, with its closure element remaining inside, blocked by the opposite edges of the closure element coming into abutment against the abutment ends of the grooves. Preferably, the bottom of the housing has an inside face over which the dispenser extends when it is in the housing, and an outside face over which the dispenser extends when it is outside the housing, after it has been rotated through approximately 180° about the line of least resistance of the closure element which remains blocked in the grooves inside the housing.

In a practical embodiment, the dispenser is provided with a draw tongue extending from the end opposite from the closure element at the opening front of the housing when the dispenser is inside the housing, so that it is possible to take hold of the tongue and to pull the dispenser out of the housing. Advantageously, the draw tongue is adapted to close off the opening front of the housing.

A user who wishes to use such a packaging assembly starts by opening the housing by pivoting the tongue of the dispenser. Then, the user pulls on the tongue to extract the dispenser from the housing. The user continues to pull until the opposite side edges of the closure element engaged in the grooves come into abutment against the abutment ends of the grooves. The dispenser is then extracted from the housing to the maximum extent. The user, who continues to hold the dispenser by its tongue, then causes the dispenser to pivot through 180° so as to bring the bottom face of the dispenser (which face is initially in contact with the inside face of the bottom of the housing) into contact with the outside face of the bottom of the housing. Said outside face of the bottom then serves as backing against which the dispenser can abut when the user actuates the dispenser. The user can then either leave the dispenser outside its housing, or else perform the above-mentioned operations in the reverse order so as to insert the dispenser back into its housing.

In an advantageous embodiment, the dispenser has a substantially flat side and a shaped-section opposite side defining a deformable actuating wall. In which case, the outside face of the bottom of the housing serves as abutment backing when the user deforms the actuating wall by pushing it in.

BRIEF DESCRIPTION OF THE DRAWINGS

The invention is described more fully below with reference to the accompanying drawings giving two embodiments of the present invention by way of non-limiting example.

In the drawings.

MORE DETAILED DESCRIPTION

Reference is made below firstly to FIGS. 1 to 5, which show a first embodiment of a packaging assembly of the invention. This packaging assembly essentially comprises two component elements, namely a fluid dispenser designated by numerical reference 1, and a housing designated by numerical reference 2.

Figure 4:
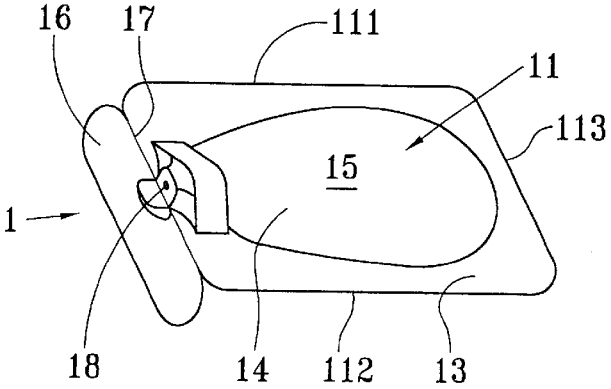
FIG. 4 is a diagrammatic perspective view of the fluid dispenser of FIGS. 1 and 3 in the open state.

The fluid dispenser 1 is made up of two sheets, two shells, or one sheet and one shell bonded together around their peripheries so as to form a reservoir between them that serves to contain a fluid. In the embodiment chosen to illustrate the present invention, the fluid dispenser 1 is made up of a shell 11 of shaped section which is advantageously thermoformed and to which a sheet 12 is bonded to serve as a sealing film for the shaped-section shell 11. The sheet 12, which may be flexible or rigid, is bonded to the concave face of the shaped-section shell 11, around the entire peripheral margin 13 thereof, as can be seen in FIG. 4. The peripheral margin 13 formed by the bonded-together zone of the shell and of the film, is substantially plane. In the center, the shaped-section shell 11 forms a dome 14 which, together with the sheet 12, defines a closed internal working volume of the fluid reservoir. In addition, the dome 14 forms a deformable actuating wall 15 on which the user can press with a finger as shown in FIG. 5 to deform the dome 14, thereby reducing the volume of the fluid reservoir.

Figure 5:
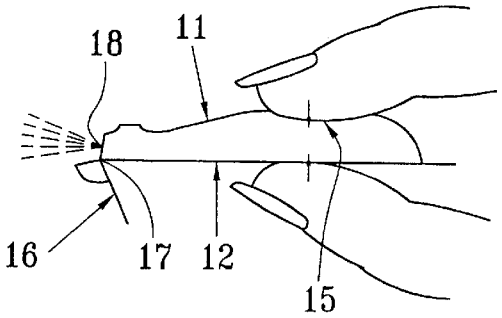
FIG. 5 is a side view of the dispenser of FIG. 4, during an actuating stage.
Figure 6:
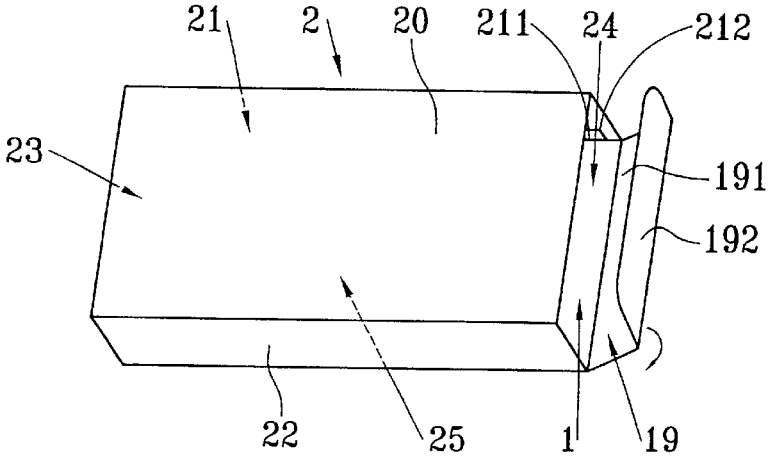
FIG. 6 is a perspective view partially from above of a second embodiment of a packaging assembly.

In addition, the fluid dispenser forms an end piece defining a dispensing orifice 18 via which fluid can be dispensed from the reservoir by pressing on the deformable actuating wall 15, as shown in FIG. 5. The dispensing orifice 18 may advantageously be formed by a substantially rigid piece received and bonded between the shaped-section shell 11 and the sealing film 12 The fluid may be dispensed through the orifice 18 in spray form: the orifice is then defined by a spray nozzle.

The fluid dispenser 1 also forms a removable closure element 16 which is adapted to close off the dispensing orifice 18 in its initial state prior to use. The removable closure element 16 is formed by a bonded together zone of the shaped-section profile 11 and of the film 12, and, in reality, it forms a portion of the above-defined substantially flat peripheral margin 13. However, the closure element 16 is defined relative to the remainder of the device by a line of least resistance 17 which passes just in front of the dispensing orifice 18. Therefore, after the closure element 16 has been removed, broken off, or folded back, the dispensing orifice 18 is unmasked, and the dispenser can be used by pressing on the deformable actuating wall 15.

The dispenser defines opposite side edges 111, 112, and a rear edge 113. The closure element 16 also forms opposite side edges 161 and 162 that are separated from the edges 111, 112 only by the line of least resistance 17. Since the edges are formed by the peripheral margin 13, they are relatively flat and rigid.

It should be noted that, in this particular embodiment of the fluid dispenser, the bottom face of the dispenser formed by the sealing film 12 is substantially plane, while the top face has a shaped section or is convex because of the presence of the dome 14. This is merely one embodiment, and naturally it is possible to imagine other embodiments, e.g. implementing two flexible sheets, or else two shaped-section members, bonded together.

The housing 2 serves to receive the fluid dispenser 1 for the purposes of protecting it, presenting it, making it easy to store tidily, or using it as an advertising medium. The housing 2 includes two opposite sides 21 and 22 which are longitudinal in overall configuration, and which are rectangular in this example. Merely by way of indication, these sides may, for example be about 1 cm high and about 5 cm to 7 cm long. The two sides 21 and 22 extend parallel to each other so that their inside faces face each other. The spacing between said inside faces is slightly greater than the width of the fluid dispenser 1 as measured between its two opposite side edges 111 & 112 or 161 & 162.

The two sides 21 and 22 are connected together by a link element which forms the top 20 of the housing. In the embodiment shown in the figures, said top 20 extends between the two sides over their entire length. As a result, anywhere along its cross-section, the housing defines a channel section. Naturally, it is possible to imagine other embodiments in which the two opposite sides are connected together merely by spacers forming an open or perforated top.

In addition, the two sides 21 and 22 are connected together by a back wall 23 which is also connected to the top 20. This can be seen clearly in FIG. 3. At the end opposite from the back wall 23, the housing forms an opening front 24.

In this embodiment, the housing does not have any bottom extending parallel to the top 20. The housing is therefore open over its bottom and over its opening front 24.

In the invention, each of the inside faces of the opposite sides 21 and 22 is provided with a longitudinal groove. The grooves or slideways 211, 211 extend over at least a portion of the length of the sides. In the embodiment shown in FIGS. 1 to 5, these longitudinal grooves 211 and 221 extend over the entire length of the inside walls of the sides. The two longitudinal grooves 211 and 221 are thus open facing one another inside the housing 2, thereby defining a slideway plane.

Figure 2:
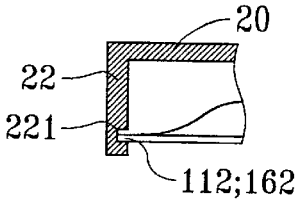
FIG. 2 is a vertical section view through a portion of the packaging assembly of FIG. 1.
Figure 1:
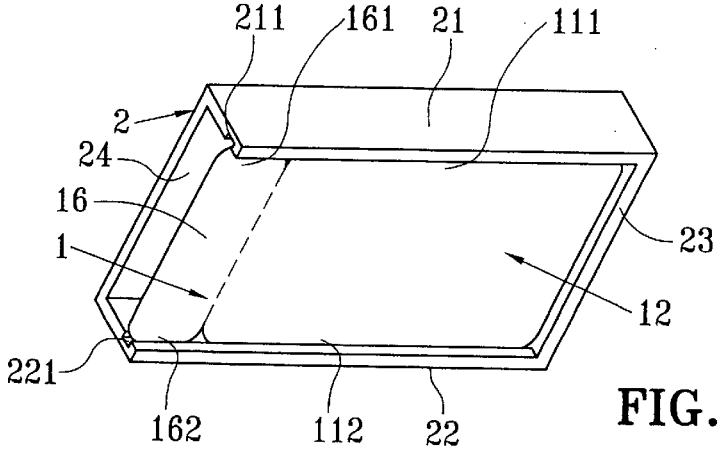
FIG. 1 is a perspective view looking partially from below of a first embodiment of a packaging assembly, with the fluid dispenser being shown as engaged fully in the housing.
Figure 3:
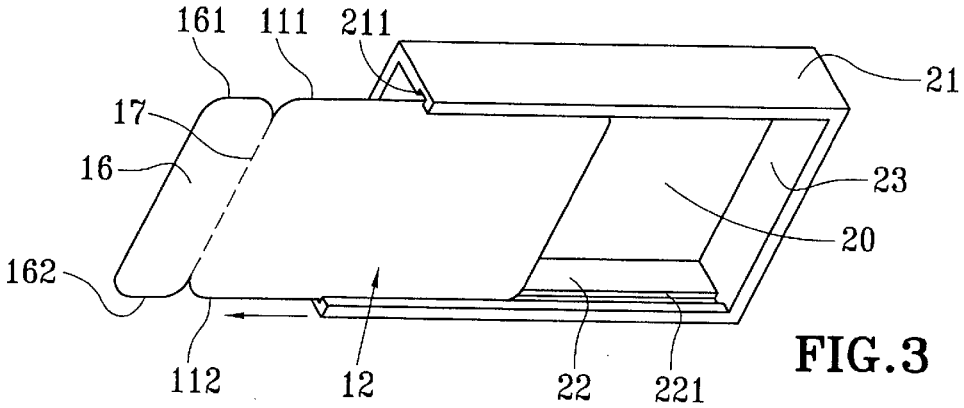
FIG. 3 is a view similar to the FIG. 1 view, with the fluid dispenser being shown as partially extracted from its housing.

In the invention, the fluid dispenser 1 is disposed in the housing 2 with its opposite side edges 111, 112, 161, and 162 engaged in the grooves 211 and 221. This can be seen clearly in FIGS. 1 and 3. It should be noted that the grooves 211 and 221 open out in the opening front 24 of the housing 2, and terminate at the back wall 23. Thus, it is possible to extract the dispenser 1 fully from the housing 2 by pulling it so as to cause its side edges 111, 112, 161 and 162 to slide in the grooves 211 and 221. It is easy to take hold of the dispenser at the opening front 24, e.g. via its removable closure element. It is also possible to engage the dispenser in the housing 2 with its closure element turned to face the back wall 23. Conversely, the dispenser can be put back in its housing 2 by re-engaging the side edges into the grooves, and by causing it to slide until its edge 113 comes into contact with the back wall 23, as shown in FIG. 1.

It should be noted that the grooves 211, 221 are situated in the vicinities of the free edges of the sides 21 and 22, i.e. distant from the top 20. The dispenser 1 is then engaged in the housing 2 with its shaped-section shell turned to face upwards, i.e. towards the top 20, and with its sealing film 12 turned to face downwards, thereby forming a bottom wall for the housing 20. Naturally, it is possible to imagine other forms of housing in which the grooves are situated at other levels on the sides 21 and 22: the dispenser may have other configurations, as described above. In the embodiment shown in FIGS. 1 to 5, it is naturally advantageous to provide the grooves in the vicinities of the free edges of the sides 21 and 22, so that the substantially flat sealing film 12 of the dispenser 1 forms the bottom of the housing 2.

In this embodiment, the side edges 111 & 112 and 161 & 162 of the dispenser 1 are engaged in the longitudinal grooves 211 and 221. However, it is possible to imagine other embodiments in which only respective portions of the sides edges are engaged in the grooves. For example, it is easy to imagine that the side edges 161 & 162 of the closure element 16 do not penetrate into the grooves 211, 221. Similarly, it is possible to imagine that the side edges are locally provided with small tabs serving to be received in the grooves 111, 121. The essential characteristic lies in the fact that the dispenser can slide inside the housing in grooves or slideways.

Reference is made below to FIGS. 6 to 10 to explain a second embodiment of a packaging assembly of the invention. This packaging assembly also comprises two component elements, namely a dispenser 1 and a housing 2.

The dispenser 1 may be substantially similar to the dispenser of the embodiment shown in FIGS. 1 to 5, i.e. it may be made up of a shaped-section shell 11 to which a sheet of sealing film 12 is bonded by heat-sealing or by means of adhesive. The shell and the sheet co-operate to define a reservoir for the fluid, which reservoir has a deformable actuating wall 15. The dispenser is further provided with a dispensing orifice 18 that is closed off in the initial state, prior to use, by a removable closure element 16 defined by a line of least resistance 17. Thus far, the dispenser may be strictly identical to the dispenser of FIGS. 1 to 5. However, the dispenser 1 of the second embodiment differs from the dispenser of the first embodiment in that the closure element 16 is wider at its opposite side edges 161 and 162 than the remainder of the dispenser at its opposite side edges 111 and 112.

Figure 7:
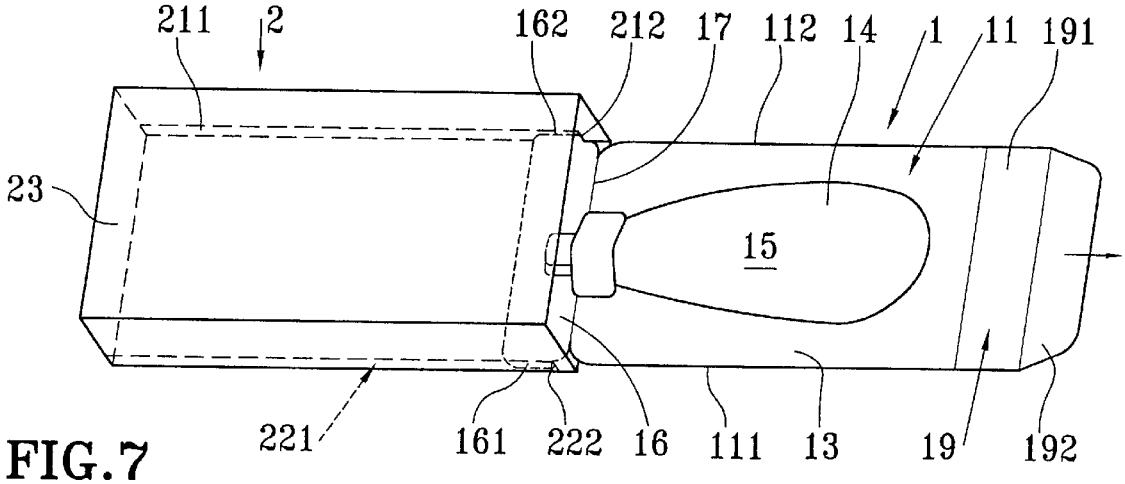
FIG. 7 is a view similar to the FIG. 6 view, with the fluid dispenser being shown as extracted from its housing.
Figure 8:
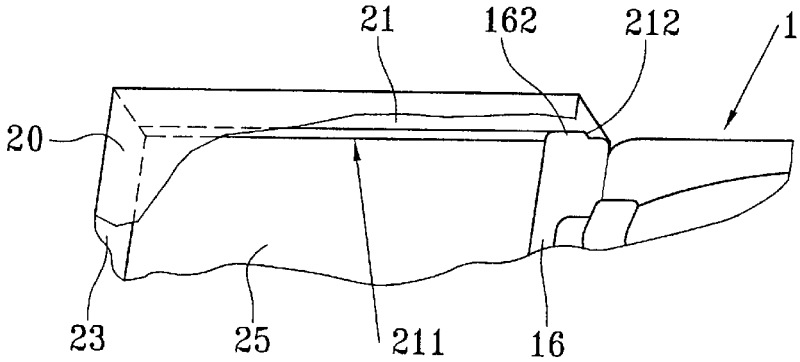
FIG. 8 is a view similar to FIG. 7, but cut away so as to show the internal structure of the housing and how it co-operates with the fluid dispenser.
Figure 9:
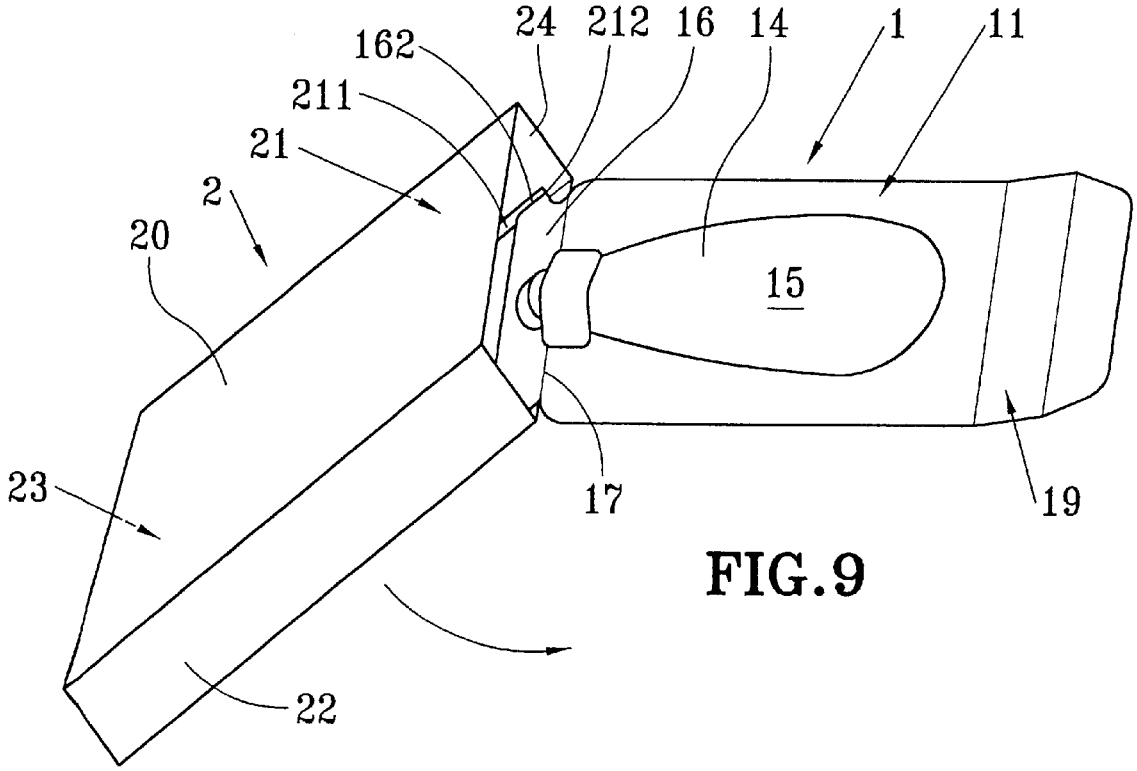
FIG. 9 is a view similar to the views of FIGS. 6 and 7, with the fluid dispenser being shown during opening.

Advantageously, the dispenser may also differ from the dispenser of FIGS. 1 to 5, in that it is provided with a draw tongue 19 that extends in alignment with the dispenser at the end opposite from the closure element 16, as can be seen clearly in FIG. 7. The draw tongue is made up of two flaps or folds 191, 192, so that the tongue 19 can be folded back along two parallel fold lines onto the dispenser. As explained below, in addition to providing a function as a handhold on which traction can be exerted, the tongue also performs a function as a closure end for closing off the housing 2.

The housing 2 also includes two opposite sides 21 and 22 connected together via a back wall 23 and via a top wall forming the top 20. In addition, this housing 2 includes a bottom wall 25 forming the bottom 25 of the housing. The housing 2 is thus in the form of a closed packet having an opening front 24 via which the inside of the housing is accessible.

As in the first embodiment, the inside faces of the sides 21 and 22 are provided with longitudinal grooves or slideways 211 and 221 which extend over most of the length of the sides 21, 22. However, in this embodiment, the grooves or slideways 211, 221 form abutment ends 212, 222 situated close to the opening front 24 without the grooves opening out into said opening front 24. This is clearly visible in FIGS. 6 to 9. Conversely, the grooves 211 and 221 extend to the back wall 23.

In the invention, the opposite side walls 161 and 162 of the closure element 16 are engaged in said grooves or slideways 211, 221 formed inside the housing 2. This is visible in FIGS. 7, 8, and 9. Since the width of the dispenser at its side edges 111 and 112 is narrower than its width at the closure element 16, the side edges 111 and 112 do not penetrate into the slideways or grooves 211, 221. Thus, only the closure element 16 is engaged via its side edges 161 and 162 in the grooves or slideways in the sides 21 and 22.

It should be noted that the dispenser 1 is engaged in the housing 2 with its closure element 16 turned to face the back wall 23, and therefore with its draw tongue 19 turned to face outwards. Thus, when the dispenser 1 is fully engaged inside the housing 2, only its draw tongue 19 projects through the opening front 24. However, since the tongue forms two foldable flaps 191 and 192, the tongue 19 can be folded back into the opening front 24, as shown in FIG. 1, so as to close it off, and thus to impart to the housing 2 a closure element for closing off its opening front 24. Conventionally, the flap 192 can be inserted into the housing 2 just beneath its top wall 20, so that the flap 191 extends parallel to the back wall 23. The dispenser assembly is then its initial storage state prior to use.

Figure 10:
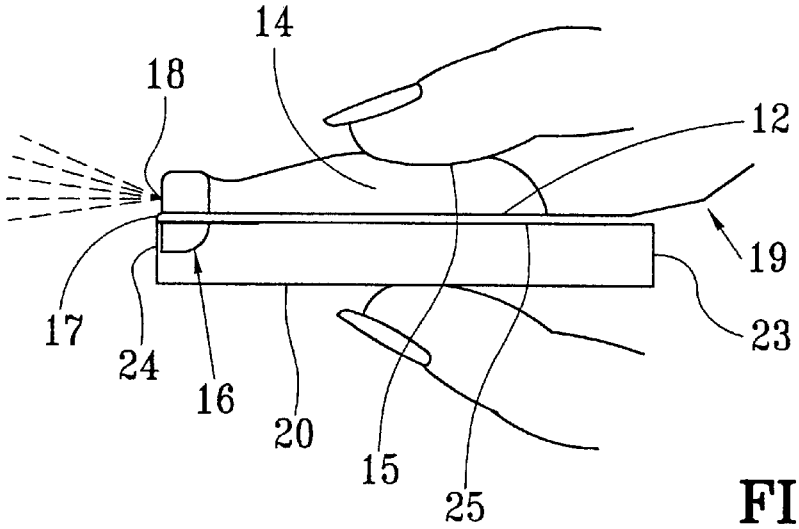
FIG. 10 is a side view of the dispensing assembly of FIGS. 6 to 9, shown during dispensing.

When a user wishes to extract the dispenser from its housing 2, the user starts by folding back the flaps 191 and 192 of the draw tongue 19 to bring it into a substantially plane configuration more suitable for taking hold of it between the thumb and the index finger, for example. Then, the user uses the tongue 19 as a draw element to pull on the dispenser 1, thereby extracting it from its housing 2 by means of the opposite edges 161 and 162 of the closure element 16 sliding in the grooves or slideways 211, 221 of the housing 2. The closure element 16 stops sliding in the grooves when the closure element 16 comes into abutment against the abutment ends 212 and 222 of the grooves 211, 221 in the vicinity of the opening front 24. This is the configuration shown in FIG. 7. The dispenser is extracted from. its housing 2, with only the closure element 16 being blocked inside the housing 2. Advantageously, the line of least resistance 17 is in alignment with the open edge of the bottom wall forming the bottom 25 of the housing 2. By pivoting the housing 2 and the dispenser 1 relative to each other, the user can then bring the sealing film 12 of the dispenser 1 into contact with the outside face of the bottom 25 of the housing 2, as shown in FIG. 10. This is obtained after the housing and the dispenser have been pivoted relative to each other about the line of least resistance 17 through an angle of 180°. The plane portion of the closure element 16 then extends parallel to the bottom face of the dispenser 1 formed by the sealing film 12. During the pivoting, the closure element 16 is folded back so as to unmask the dispensing orifice 18 which is then facing towards the outside of the housing 2 as can be seen in FIG. 10. By using the bottom 25 as abutment backing, the user can push in the deformable actuating wall 15 of the dome 14 to put the fluid under pressure and to deliver it through the dispensing orifice 18. The housing 2 participates actively in the fluid-dispensing operation, i.e. in actuating the dispenser 1 by serving as a backing member: the user can take hold of the packaging assembly between the thumb and the index finger, with the thumb pressing against the actuating wall 15, and the index finger pressing against the top 20 of the housing 2. This is shown in FIG. 10. Naturally, it is necessary to provide a relatively strong and rigid housing structure that is not deformed whenever the slightest pressure is exerted on it.

In both of the above-described embodiments of the invention, the dispenser 1 co-operates with the housing 2 via sliding engagement inside grooves or slideways formed by the sides of the housing. This sliding engagement makes it possible to withdraw the dispenser from the housing in guided manner, but also to retain a portion of the dispenser to facilitate opening said dispenser, as in the second embodiment.

What is claimed is:

1. A packaging assembly comprising:

a fluid dispenser defining substantially parallel opposite side edges; and a housing having two substantially parallel opposite sides;

wherein each side defines an inside wall, with the two inside walls facing each other, and each inside wall is provided with a respective longitudinal groove which extends over at least a portion of the length of the side, the two resulting grooves being parallel, at least a portion of each of the opposite side edges of the dispenser being slidably engaged in the corresponding one of said grooves in the housing, so as to enable the dispenser to be slidingly extracted from the housing.

2. A packaging assembly according to claim 1, in which the housing includes a back wall interconnecting the two sides at one end of each them, and an opening front at their other ends, and a top interconnecting the sides and the back wall.

3. A packaging assembly according to claim 2, in which the housing does not have a bottom, but a bottom is however formed for it by a bottom of the dispenser, so that the bottom of the dispenser is visible when the dispenser is in its housing.

4. A packaging assembly according to claim 2, in which the housing includes a bottom which is parallel to the top and which interconnects the sides and the back wall.

5. A packaging assembly according to claim 4, in which only the opposite side edges of the closure element are engaged in the grooves of the housing.

6. A packaging assembly according to claim 5, in which the grooves define respective abutment ends in the vicinity of t he opening front so that the dispenser can be partially extracted from the housing, with its closure element remaining inside, blocked by the opposite edges of the closure element coming into abutment against the abutment ends of the grooves.

7. A packaging assembly according to claim 6, in which the bottom of the housing has an inside face over which the dispenser extends when it is in the housing, and an outside face over which the dispenser extends when it is outside the housing, after it has been rotated through approximately 180° about the line of least resistance of the closure element which remains blocked in the grooves inside the housing.

8. A packaging assembly according to claim 1, in which the dispenser includes a removable closure element closing off a fluid dispensing orifice, said closure element being defined by a line of least resistance.

9. A packaging assembly according to claim 8, in which the closure element defines a portion of each of the opposite side edges of the dispenser, which portion is engaged in the grooves in the housing.

10. A packaging assembly according to claim 8, in which the dispenser is provided with a draw tongue extending from the end opposite from the closure element at the opening front of the housing when the dispenser is inside the housing, so that it is possible to take hold of the tongue and to pull the dispenser out of the housing.

11. A packaging assembly according to claim 10, in which the draw tongue is adapted to close off the opening front of the housing.

12. A packaging assembly according to claim 1, in which the dispenser has a substantially flat side and a shaped-section opposite side defining a deformable actuating wall.

13. A packaging assembly according to claim 1, in which the opposite side edges are substantially flat and rigid.

* * * * *